US007137728B2

(12) United States Patent
Witham et al.

(10) Patent No.: US 7,137,728 B2
(45) Date of Patent: Nov. 21, 2006

(54) LAMP KEYING SYSTEM

(75) Inventors: David L. Witham, Ventura, CA (US); Roberto E. Arance, Castaic, CA (US); Keith M. Crawford, Canyon Country, CA (US); Michael A. Pedersen, Van Nuys, CA (US)

(73) Assignee: Ultraviolet Devices, Inc., Valencia, CA (US)

( * ) Notice: Subject to any disclaimer, the term of this patent is extended or adjusted under 35 U.S.C. 154(b) by 119 days.

(21) Appl. No.: 10/754,851

(22) Filed: Jan. 9, 2004

(65) Prior Publication Data

US 2004/0141332 A1 Jul. 22, 2004

Related U.S. Application Data

(60) Provisional application No. 60/440,908, filed on Jan. 15, 2003.

(51) Int. Cl.
*H01R 33/00* (2006.01)

(52) U.S. Cl. ..... 362/652; 439/242; 439/681; 362/548

(58) Field of Classification Search ..... 439/242, 439/677–79, 680–81
See application file for complete search history.

(56) References Cited

U.S. PATENT DOCUMENTS

| | | | | |
|---|---|---|---|---|
| 5,381,070 | A * | 1/1995 | Tuttle et al. | 313/318.01 |
| 5,521,460 | A * | 5/1996 | Zhu | 313/318.09 |
| 6,083,021 | A * | 7/2000 | Lau | 439/227 |
| 6,323,588 | B1 * | 11/2001 | Lilljedahl et al. | 313/318.1 |
| 6,346,767 | B1 * | 2/2002 | Swadel et al. | 313/318.01 |

* cited by examiner

*Primary Examiner*—Ali Alavi
*Assistant Examiner*—Adam C. Rehm
(74) *Attorney, Agent, or Firm*—Cislo & Thomas, LLP

(57) ABSTRACT

Provided are exemplary embodiments of a system and method for allowing predetermined and/or preconfigured lamp assemblies to be utilized with lamp fixtures. The exemplary embodiments may include a fixture assembly, a key configured to couple to the lamp fixture, and a lamp assembly including a base with a receiving structure, wherein the receiving structure is configured to engage the key, such that only predetermined lamp assemblies may couple to the fixture assembly.

22 Claims, 3 Drawing Sheets

LAMP KEYING SYSTEM

CROSS-REFERENCES TO RELATED APPLICATIONS

This is a utility application claiming priority from U.S. Provisional Application Serial No. 60/440,908, entitled APPARATUS AND METHOD FOR KEYING LAMP AND LAMP FIXTURE filed on Jan. 15, 2003, which is incorporated herein by this reference thereto for all purposes.

BACKGROUND

Manufacturers and agencies associated with the lighting industry may have developed standard lamp base designs (incorporated into the lamp assembly itself) and corresponding lamp holder designs. The basis for these designs may have been to provide the market with standardized products to facilitate a competitive environment where multiple lamp manufacturers and lamp fixture manufactures could develop and sell interchangeable components that met the basic needs of the lighting market. Standard lamp bases standards like (but not limited to) T5, T8, Th, T12, 2G7, 2G1 1, G23 and GX23 (as referred to for lamps manufactured by Philips Lighting and others) may have been developed as common standards to facilitate the implementation of lamps into various applications. Manufacturers may have developed many different lamp models based on these standard lamp bases.

In many applications the lamp base standards may serve the industry well. However in certain applications, straight utilization of the standard lamp base configurations can be detrimental.

It may be typical to find different model lamps manufactured on one particular lamp base standard, that vary greatly in terms of lamp voltage, current, illumination and power rating. This may present problems with respect to proper and safe usage of lamps with certain lamp fixtures. Straight utilization of the standard lamp bases by manufacturers within lamp fixtures may create a situation where the oft-unknowledgeable user may easily, and potentially unknowingly, implement the wrong lamp type for the device employed. Sometimes lamp models with different power and current ratings utilize the same apparent mechanical design (e.g. Philips Lighting TUV36WPLL and TUV60WPLL), which may increase the probability of incorrect lamp implementation by an unknowledgeable end user.

One problem may be performance. Lamp power may many times be critical to the performance of the system employing the lamp. For instance, where lamps are used for non-illumination purposes (including germicidal applications), the effective dosage of the system may be predominately affected by the power of the lamp utilized. Utilization of the incorrect lamp in these systems can result in failure of the system to achieve critical dosing, which may be required and/or specified. This may result in the device failing to meet the performance specified.

Another problem may be reliability and liability. The reliability of the device employed can be adversely affected by the implementation of the incorrect lamp. Impedance differences associated with different lamp models can induce problems with an employed system. Reliability and liability issues surrounding misapplication of lamps may include implementation of an incorrect lamp that may cause premature lamp failure resulting in loss of performance and warrantee liability. Furthermore, implementation of an incorrect lamp may cause premature ballast (power supply) and controller failure resulting in loss of performance and warrantee liability. Implementation of an incorrect lamp can cause operation of a device outside of acceptable thermal and electrical limits. This can result in loss of performance, warranty liability and personal safety liability. Also, as discussed in the preceding sections, the implementation of an incorrect lamp resulting in diminished dosage performance may result in injury (especially in germicidal applications) and personal liability claims by the consumer.

Yet another problem may be marketing. In many cases, it may be advantageous to the manufacturer and provider of equipment to require replacement parts through their own channels of distribution. With a standard lamp base and fixture, replacement lamps may come from any source and the channels of distribution and sales cannot be assured.

Some manufacturers may have made (or deferred to) the decision to offer products that rely primarily on the knowledge of the user and the utilization of the standard lamp bases to ensure the proper continued operation of their systems in application. This strategy may result in a potential for misapplication of their systems, but also it may achieve a lowest cost approach for the initial device sale and also in lamp replacement sales.

What is needed is a system that may address these and other problems associated with lamp fixtures and assemblies.

These and other objects and advantages of this invention will be apparent from the following descriptions, specifications and drawing.

SUMMARY

Provided are exemplary embodiments of a system and method for allowing predetermined and/or preconfigured lamp assemblies to be utilized with lamp fixtures. The exemplary embodiments may include a fixture assembly, a key configured to couple to the lamp fixture, and a lamp assembly including a base with a receiving structure, wherein the receiving structure is configured to engage the key, such that only predetermined lamp assemblies may couple to the fixture assembly.

DETAILED DESCRIPTION

The detailed description set forth below in connection with the appended drawings is intended as a description of exemplary embodiments and is not intended to represent the only forms in which the embodiments may be constructed and/or utilized. The description also sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
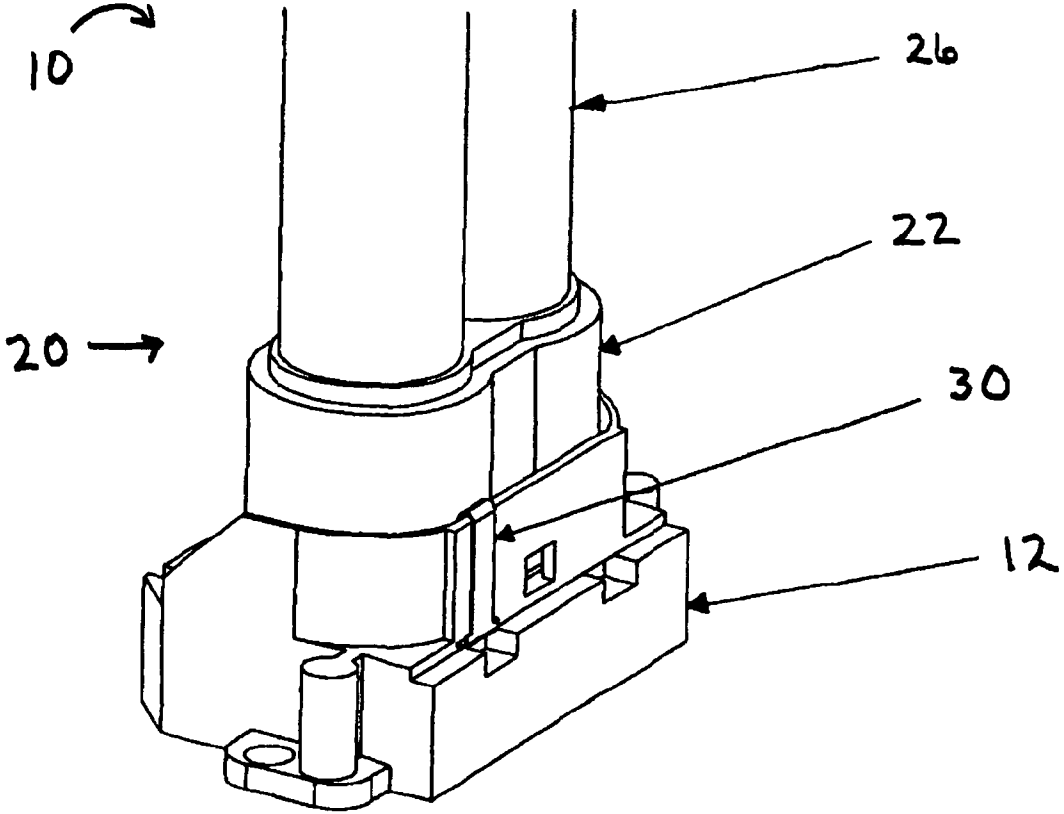
FIG. 1 is a perspective view of a system according to an exemplary embodiment.

FIG. 1 shows a perspective view of a lamp system according to an exemplary embodiment, generally at 10. The lamp system 10 may include a lamp assembly 20, a lamp support in the form of a fixture or fixture assembly 12, and a key 30. Fixture assembly 12 may be configured to receive lamp assembly 20 to operatively receive and couple to lamp assembly 20.

Lamp assembly 20 may include a base 22 and an electromagnetic energy source 26. Base 22 may be configured to couple to fixture assembly 12, such that electromagnetic energy source 26 will emit electromagnetic energy when power is applied, and if base 22 is operatively coupled to fixture assembly 12.

Key 30 may be configured such that only certain types of lamp assemblies may be utilized with fixture assembly 12. In this manner, only certain predetermined and/or preconfigured lamp assemblies may be utilized with particular fixture assemblies. This may decrease the likelihood that improper lamp assemblies are utilized with particular fixture assemblies, setups, and lamp systems. With this configuration only proper lamp assemblies may operatively couple to fixture assemblies. The use of incorrect lamp assemblies for the particular application, configuration, and/or fixture assembly may be reduced or eliminated.

Fixture assembly 12 may be made from plastic, metal, or other materials, as desired. It may be made from commonly used polymers and plastics, such as existing lamp fixture assemblies. Key 30 may be made from plastic, metal, or other materials, as desired. It may be made from metal, such that it may slightly flex and allow coupling of lamp assembly 20 to fixture assembly 12.

Base 22 may be made from a polymer, plastic, metal or other material, as desired. It may be made from plastics, as may be currently utilized for lamp bases. Electromagnetic energy source 26 may be incandescent, ultra violet, or other type of electromagnetic energy source. It will be appreciated that other electromagnetic energy sources may be utilized for other applications, as desired.

The foregoing is readily apparent when considering that in referring to the FIG. 1, which may illustrate a standard lamp fixture assembly 12 which may have been modified in order to achieve the desiratum of the invention, which in this embodiment may involve modifying the fixture assembly 12 to receive clip or key 30 in stable fashion. The key 30 may couple to fixture assembly 12 such that the key 30 couples to a coupling structure of fixture assembly.

Figure 2:
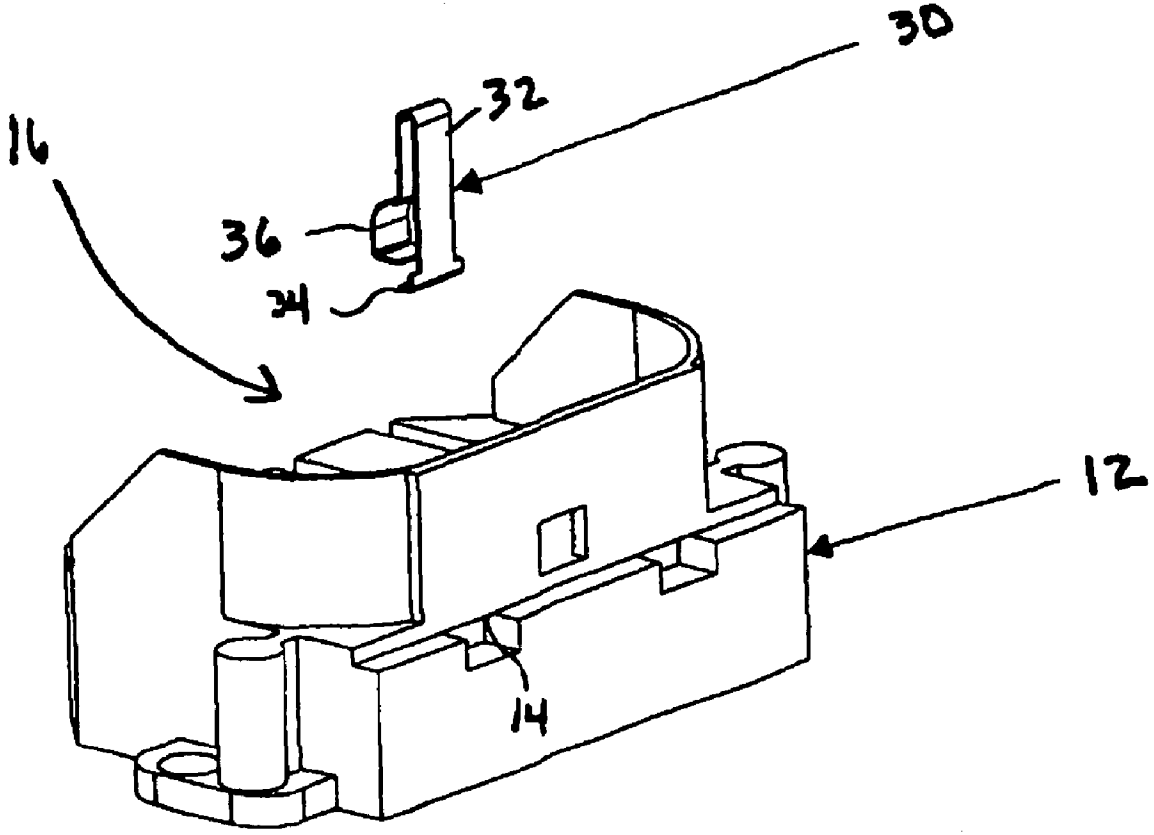
FIG. 2 is a detailed view of a fixture and key according to an exemplary embodiment.

The more detailed view of fixture assembly 12 and key 30 are shown in FIG. 2. As shown, key 30 may include an extending portion 32, which curves around and forms a fixture coupling portion 34, and a base engaging portion 36. Fixture coupling portion 34 may be configured to couple to a coupling structure 14 of fixture assembly 12. With this configuration a key may be utilized with a fixture assembly to allow only certain lamp assemblies to be utilized with the fixture assembly.

It will be appreciated that although fixture coupling portion 34 in this embodiment is shown as a lip-type configuration, other configurations may be utilized, as desired. Similarly, although coupling structure 14 is shown as a recess or slot, other configurations may be utilized, as desired.

Extending portion 32 may be configured to extend over a portion of fixture assembly 12 such that it will extend into a receptacle portion 16 of fixture assembly 12, which may be configured to receive a lamp assembly. Furthermore, key 30 may include a base engaging portion 36, which may be configured to engage a portion of lamp assembly and/or allow lamp assembly to operatively couple to fixture assembly 12. Utilizing this key configuration, only predetermined or preconfigured lamp assemblies may be utilized with a fixture assembly. Receptacle portion 16 may be configured to couple to a base portion of a lamp assembly to allow the lamp assembly to operatively couple to the fixture assembly.

Figure 3:
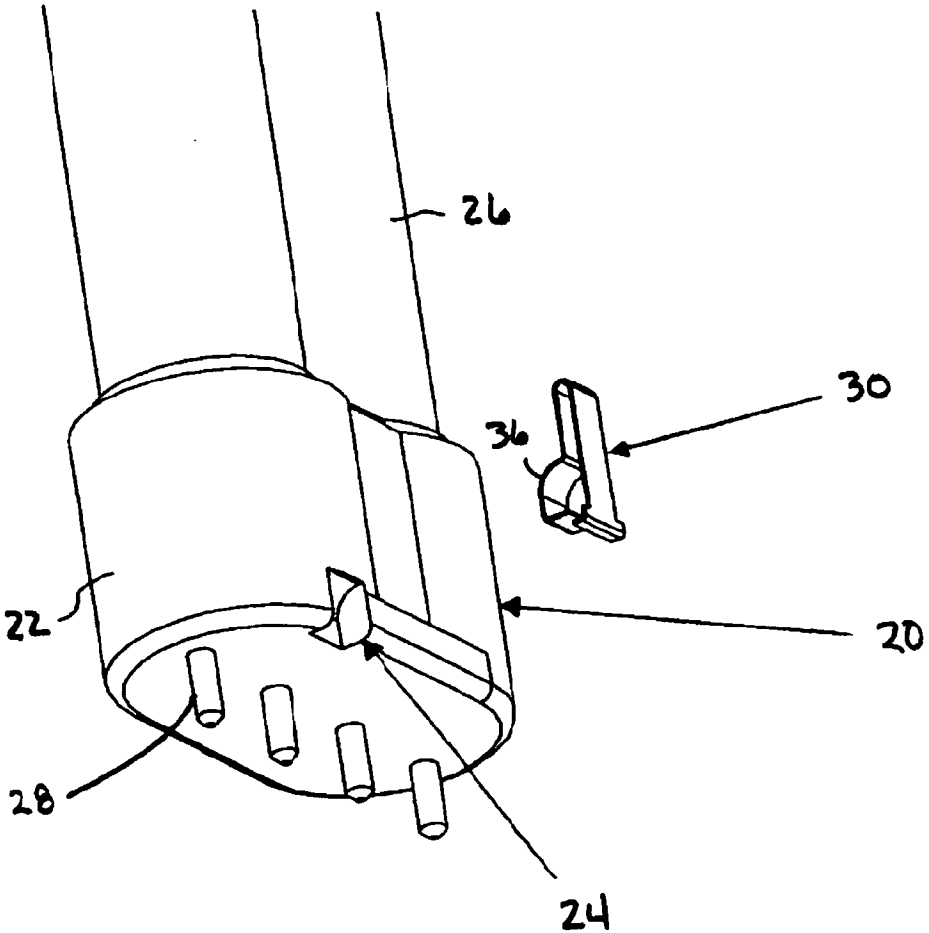
FIG. 3 is a detailed view of a lamp assembly and key according to an exemplary embodiment.

FIG. 3 shows a more detailed view of lamp or lamp assembly 20 and key 30. In this exemplary embodiment, lamp assembly 20 again may include base 22 and electromagnetic energy source 26. Lamp assembly 20 may further include a receiving structure 24. Receiving structure 24 may be configured to couple to base engaging portion 36, of key 30. It will be appreciated that although receiving structure 24 is shown as a recess or slot, other configurations may be utilized, as desired. Furthermore, different configurations for key 30 may be utilized to engage or couple to lamp assembly 20, as desired.

Base engaging portion 36 of key 30 may be configured to fit into recess 24 and may be placed within the system at different positions to allow different types of lamp assemblies to be utilized with a single fixture assembly. Similarly, receiving structure 24 may be positioned at different positions adjacent to the lamp assembly. Different positions for receiving structure 24 may be utilized with different types of lamp assemblies to reduce the likelihood that a user will install an improper lamp assembly into a fixture. With this configuration, and position of key 30, lamp assembly 20 may operatively couple to a fixture assembly such that it will illuminate and operate properly.

With this configuration, key 30 may be utilized with existing fixture assemblies, such that only certain lamp assemblies may be utilized within a lamp system and fixture assemblies. Furthermore, current lamp assemblies may be modified to allow operatively coupling to proper, predetermined fixture assemblies, such that a user may be less likely to install an improper lamp assembly with a particular lamp system and/or fixture.

Additionally, systems may be originally configured to include keys and or receiving structure 24, or other configuration to reduce or eliminate the use of improper replacement lamp assemblies with a particular fixture assembly. In this manner, lamp assemblies that do not produce a desired result may be reduced or eliminated from use when a user is replacing the lamp assembly within a lamp system. This may be particularly important when a certain type of ultra violet lamp or other type of lamp must be utilized for a particular configuration and/or utilization, such as in a disinfection system, which may require certain wattages, etc. for proper operation.

Lamp assembly 20 may also include electrical contacts 28, which may be configured electrically couple to corresponding electrical contacts, not shown, of fixture assembly 12. Electrical contacts 28 may allow current, when applied, to flow to electromagnetic radiation source 26 to power electromagnetic radiation source 26, when lamp assembly 20 is operatively coupled to fixture 12.

Referring to the FIG. 3 illustration, it will be noted that base 22, in this instance, is formed with a custom receiving structure 24 such that base engaging portion 36 of key 30 will not prevent lamp assembly 20, and more specifically base 22, from becoming operatively associated with fixture assembly 12.

Thus a very simple straight-forward methodology and device may be employed to insure that a lamp assembly, for example, 20 is not associated with a fixture or receptacle 12 for which it is not intended to be used.

While the embodiment illustrated shows but a single protrusion or base engaging portion, to be associated with the receiving structure 24, it will be appreciated that more than one slot and/or key may be utilized for various applications, as desired.

Additionally, while a specific configuration of a receiving structure 24 and base engaging portion 36 has been illustrated and described, it will be appreciated that the slots and accommodating protrusions may take various polygonal and geometric shapes and all such matters are within the contemplation of the invention.

With respect to the lamp, the exemplary embodiments of a method and system provided herein may provide an inexpensive solution to customize standard lamp bases, which may minimize the opportunity of lamp misapplication in systems. The resulting lamp configuration may incorporate coupling configurations (such as but not limited to a slot or recess) in addition to the normal geometric aspects of standard lamp base (such as but not limited to standard lamp bases 2G11, 2G7, G23, GX23). This coupling configuration may allow a corresponding and reciprocal key, rib or post to operatively engage the corresponding lamp base, holder or fixture. It will be appreciated that other configurations may be utilized, as desired.

With respect to the lamp holder, the exemplary embodiments of a method and system provided herein may include an inexpensive configuration to customize existing commercially available lamp holders, bases and fixtures, and/or may develop inexpensive new lamp holder designs that may minimize lamp misapplication. The resulting lamp fixture configuration may incorporate a receiving structure (including but not limited to a rib, bracket or post) into the mating surface(s) in addition to the normal geometric aspects of a particular standard lamp base between the lamp and lamp holder. This receiving structure may correspond to the additional and corresponding receiving structure adjacent to the lamp base (as noted above).

The incorporation of the receiving structure, in addition to the normal geometric attributes of the standard lamp base type, may create a physical interference to prevent normal installation of an improper lamp into this fixture. The lamp may be effectively matched or "keyed" to fit into the corresponding lamp fixture. However, this receiving structure may also allow the implementation of a lamp base that has the appropriate reciprocal interference relief features.

With this configuration, the lamp device manufacturer may provide a cost effective system to end users that may minimize the opportunity for misapplication of lamps within the lamp device.

This invention may establish a method for "keying" a lamp and lamp holder to minimize the potential for misapplication of lamps within a lamp fixture. The method may provide a means to implement unique mechanical features to be added, modified or incorporated to standard lamp assemblies and lamp fixtures/holders/receptacles. The feature provides may be a 'male to female' design relationship between the two components (lamp base and lamp receptacle) that may be unique to minimize the possibility for incorporation of an incorrect lamp into an existing fixture, however, other configurations may be utilized, as desired. This method may incorporate mechanical interference into the lamp fixture that may prevent the normal insertion of a lamp without the proper and corresponding interference relief feature.

With this configuration, existing lamp fixtures and lamps may be modified, which may prevent misapplication of lamp to fixture, which may insure that lamps of the various types are associated only with fixtures for which the lamp is intended to be used. Furthermore, exemplary embodiments may provide a methodology and system for insuring that correct lamps are used in specific applications, and that misuse may be eliminated or reduced by the provision of a keying element or elements.

Exemplary embodiments may also provide a means of insuring that ultraviolet light lamp assemblies may be uniquely configured so that they may only be associated with fixtures for which they are intended to be associated. Furthermore, exemplary embodiments may provide an ultraviolet light lamp fixture, which may be configured so as to receive a particular and specific ultraviolet lamp base for a specific intended purpose, and so that errors in placement as to energy level and the like are eliminated or reduced. Further provided may be a methodology for insuring that ultraviolet lamp assemblies are placed in specific fixtures for which one, and only one type, of lamp is intended to be utilized.

In closing, it is to be understood that the exemplary embodiments described herein are illustrative of the principles of the present invention. Other modifications that may be employed are within the scope of the invention. Thus, by way of example, but not of limitation, alternative configurations may be utilized in accordance with the teachings herein. Accordingly, the drawings and description are illustrative and not meant to be a limitation thereof.

What is claimed is:

1. A lamp keying system, comprising:

a lamp base including a recess at one end;

a lamp support detachably coupled to said lamp base including a first portion to receive said lamp base and a second portion being recessed away from said received lamp base; and at least one removable lamp keying member configured to extend over said first portion of said lamp support, said lamp keying member including a first leg to mate with said recessed second portion of said lamp support and a second leg to mate with said recess of said lamp base when said lamp base is operatively received in said first portion to prevent the utilization of an improper lamp base type.

2. The lamp keying system of claim 1, wherein said at least one lamp keying member has a substantially solid clip-like configuration.

3. The lamp keying system of claim 2, wherein said lamp base is operatively coupled to an electromagnetic energy source.

4. The lamp keying system of claim 3, wherein said lamp base is configured for operative coupling to said lamp support.

5. The lamp keying system of claim 1, wherein said at least one lamp keying member is configured to allow at least one pre-selected lamp base type to be operatively associated with said lamp support.

6. The lamp keying system of claim 2, wherein said lamp support is made of plastic material.

7. The lamp keying system of claim 2, wherein said lamp support is made of metal.

8. The lamp keying system of claim 2, wherein said lamp support is made of polymer type material.

9. The lamp keying system of claim 1, wherein said at least one lamp keying member is made of plastic material.

10. The lamp keying system of claim 1, wherein said at least one lamp keying member is made of metal.

11. The lamp keying system of claim 10, wherein said at least one metal lamp keying member is configured to flex sufficiently to allow operative coupling of said lamp base to said lamp support.

12. The lamp keying system of claim 3, wherein said lamp base is made of polymer material.

13. The lamp keying system of claim 3, wherein said lamp base is made of plastic material.

14. The lamp keying system of claim 3, wherein said lamp base is made of metal.

15. The lamp keying system of claim 3, wherein said operatively coupled electromagnetic energy source is an ultraviolet light source.

16. The lamp keying system of claim 1, wherein said second leg includes a substantially convex section.

17. The lamp keying system of claim 16, wherein said substantially convex section of said second leg is configured to mate with said recessed end of said lamp.

18. The lamp keying system of claim 1, wherein said first leg is configured to removably mate with said recessed second portion.

19. The lamp keying system of claim 1, wherein said lamp base includes a plurality of electrical contacts.

20. The lamp keying system of claim 19, wherein said electrical lamp base contacts are configured for operative coupling to corresponding electrical contacts provided in said first portion of said lamp support.

21. A lamp keying system, comprising:

a lamp base;

a lamp support configured to detachably receive said lamp base, said lamp support being recessed away from said received lamp base; and at least one removable keying element configured at one end for selectively interlocked coupling to said received lamp base, said at least one keying element configured at another end to removably mate in selectively interlocked manner with said recessed lamp support when said lamp base is operatively received in said lamp support to prevent the use of an improper lamp base type.

22. The lamp keying system of claim 21, wherein said at least one keying element has a substantially solid clip-like configuration.

* * * * *